US009307839B2

(12) United States Patent
Cvek

(10) Patent No.: US 9,307,839 B2
(45) Date of Patent: Apr. 12, 2016

(54) ADJUSTABLE ARMREST

(71) Applicant: Sava Cvek, Jamaica Plain, MA (US)

(72) Inventor: Sava Cvek, Jamaica Plain, MA (US)

( * ) Notice: Subject to any disclaimer, the term of this patent is extended or adjusted under 35 U.S.C. 154(b) by 0 days.

(21) Appl. No.: 14/145,929

(22) Filed: Dec. 31, 2013

(65) Prior Publication Data

US 2014/0183922 A1 Jul. 3, 2014

Related U.S. Application Data

(60) Provisional application No. 61/747,907, filed on Dec. 31, 2012.

(51) Int. Cl.
*A47C 1/03* (2006.01)

(52) U.S. Cl.
CPC ..... *A47C 1/03* (2013.01)

(58) Field of Classification Search
CPC ..... A47C 1/03
USPC ..... 297/411.36
See application file for complete search history.

(56) References Cited

U.S. PATENT DOCUMENTS

| | | | | |
|---|---|---|---|---|
| 6,974,190 | B1 * | 12/2005 | Hung | 297/411.36 |
| 7,156,466 | B1 * | 1/2007 | Chang | 297/411.36 |
| 7,533,939 | B2 * | 5/2009 | Fookes et al. | 297/411.36 |
| 2003/0214171 | A1 * | 11/2003 | Burwell et al. | 297/411.36 |
| 2007/0024100 | A1 * | 2/2007 | Chan | 297/411.36 |
| 2007/0164595 | A1 * | 7/2007 | Chi | 297/411.36 |
| 2008/0191537 | A1 * | 8/2008 | Oda | 297/411.36 |
| 2009/0096271 | A1 * | 4/2009 | Tsai | 297/411.36 |
| 2009/0184560 | A1 * | 7/2009 | Tsai | 297/411.36 |
| 2011/0221251 | A1 * | 9/2011 | Tsai | 297/411.36 |
| 2011/0248542 | A1 * | 10/2011 | Tsai | 297/411.36 |
| 2011/0248543 | A1 * | 10/2011 | Hitchcock et al. | 297/411.36 |
| 2012/0098318 | A1 * | 4/2012 | Chen | 297/411.36 |
| 2012/0104823 | A1 * | 5/2012 | Lai | 297/411.36 |
| 2013/0033082 | A1 * | 2/2013 | Huang | 297/411.36 |
| 2013/0320739 | A1 * | 12/2013 | Chen | 297/411.36 |
| 2014/0117736 | A1 * | 5/2014 | Colasanti et al. | 297/411.36 |
| 2014/0183922 | A1 * | 7/2014 | Cvek | 297/411.36 |

* cited by examiner

*Primary Examiner* — David R Dunn
*Assistant Examiner* — Timothy J Brindley
(74) *Attorney, Agent, or Firm* — Thomas P. O'Connell; O'Connell Law Firm

(57) ABSTRACT

An adjustable armrest with an central core with a longitudinal channel, a locking slide slidably received in the longitudinal channel, and locking members retained by the central core. The locking slide has a first position wherein the locking members are pressed to a position projecting outboard of the elongate central core and a second position wherein the locking members are permitted to retract within the elongate central core. An elongate core sleeve receives the elongate central core, and the core sleeve has a plurality of longitudinally spaced inlets and ridges. A first arm portion is fixed in relation to the elongate central core, and a second arm portion fixed in relation to the elongate core sleeve. The first arm portion can be extended and retracted in relation to the second arm portion by an actuation of the locking slide from the first position to the second position.

14 Claims, 10 Drawing Sheets

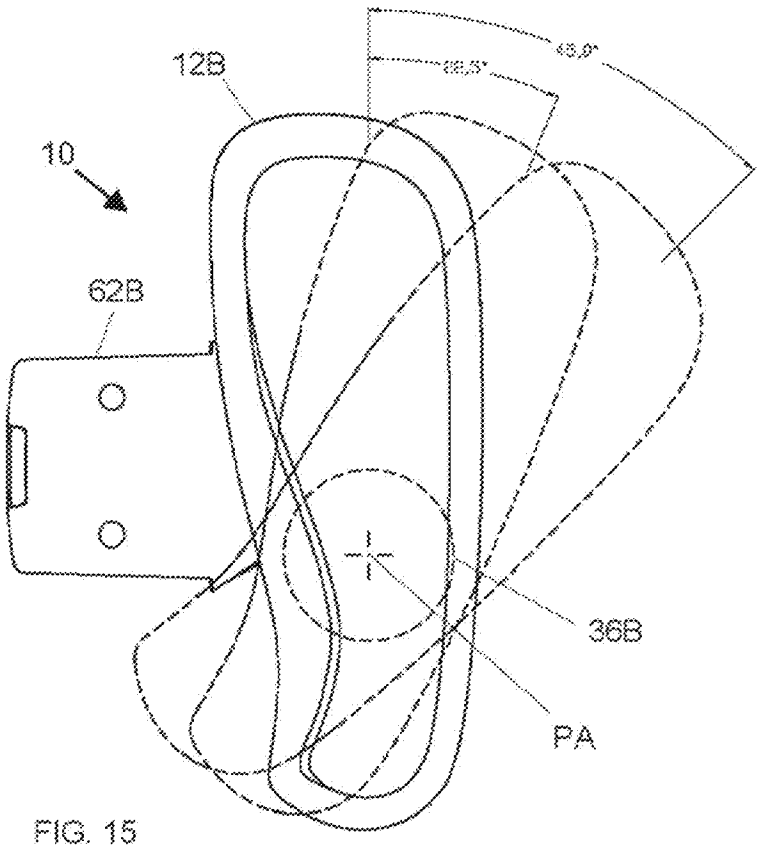
FIG. 15
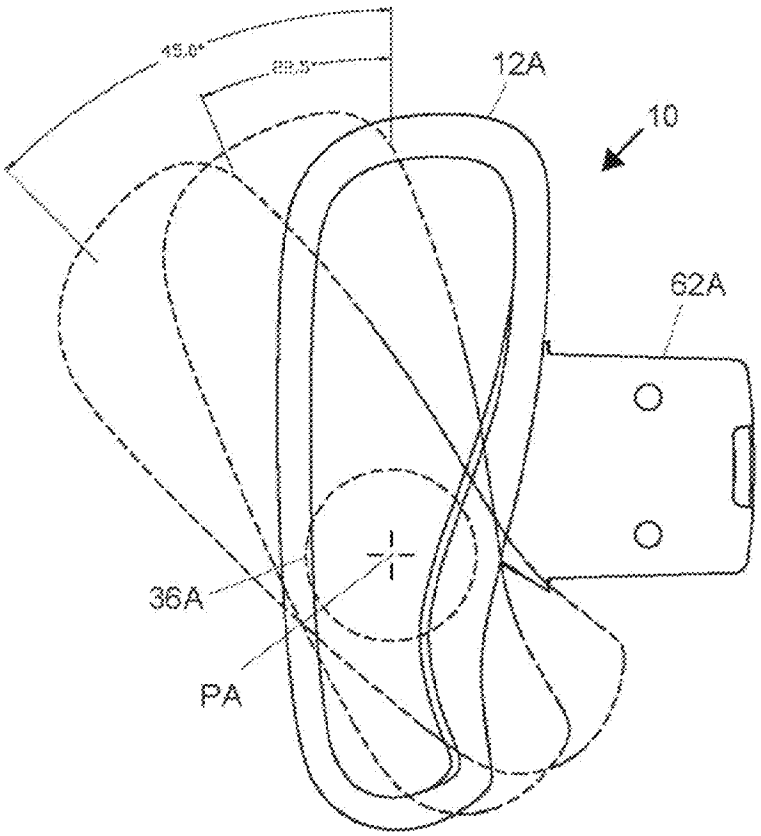

ADJUSTABLE ARMREST

FIELD OF THE INVENTION

The present invention relates generally to seating structures. More particularly, disclosed herein is an adjustable armrest for task chairs and similar seating constructions.

BACKGROUND OF THE INVENTION

It will be appreciated that a multitude of adjustable armrests for task chairs have been disclosed by the prior art. However, it is recognized that stability and reliability continue to be recognized challenges for the adjustable armrest structures of the prior art. Moreover, smooth and easy operation remain relatively elusive in the field of adjustable armrests. Instead, many armrests of the prior art are wobbly and prone to malfunction and unreliable operation.

Accordingly, an adjustable armrest that is stable, smooth and easy in operation, and reliable would represent a useful advance in the art.

SUMMARY OF THE INVENTION

Accordingly, the present invention is founded on the basic object of providing an adjustable armrest for seating that is stable and reliable.

A further object of embodiments of the invention is to provide an adjustable armrest for seating that is smooth and convenient in operation.

These and further objects and advantages of the present invention will become obvious not only to one who reviews the present specification and drawings but also to those who have an opportunity to experience an embodiment of the adjustable armrest disclosed herein in operation. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF DRAWINGS

In the accompanying drawing figures:

FIG. 15 is a top plan view of left and right adjustable armrests with the armrest pad in varied positions.

DETAILED DESCRIPTION OF PREFERRED EMBODIMENTS

The adjustable armrest disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

Figure 1:
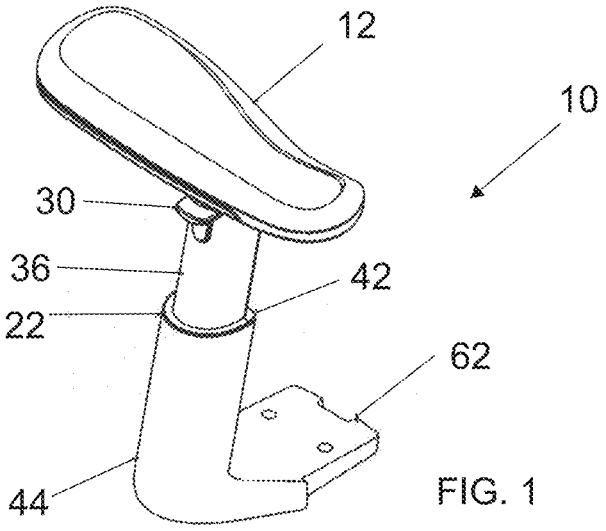
FIG. 1 is a perspective view of an adjustable armrest according to the invention disclosed herein.
Figure 2:
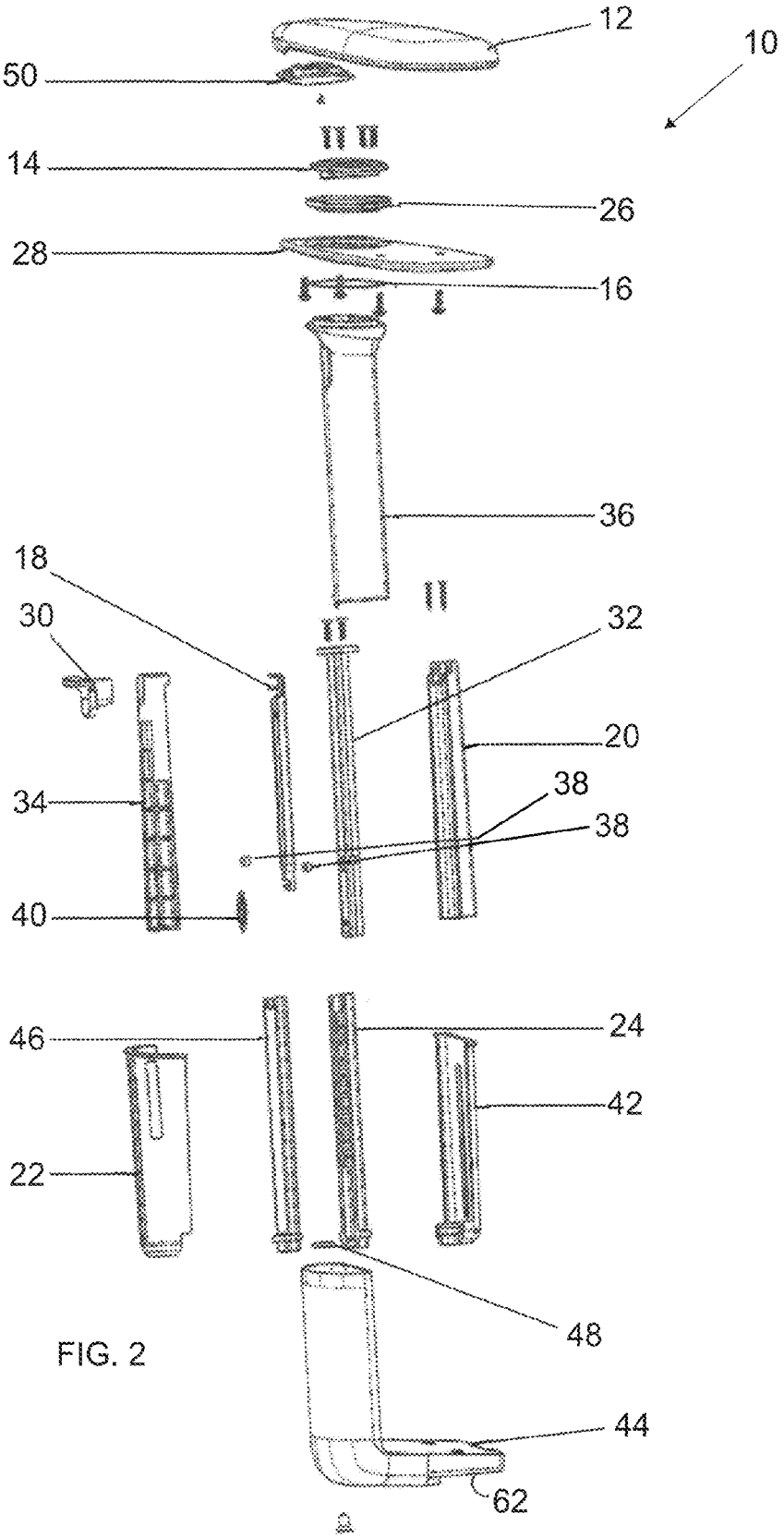
FIG. 2 is an exploded perspective view of the adjustable armrest of FIG. 1.
Figure 3:
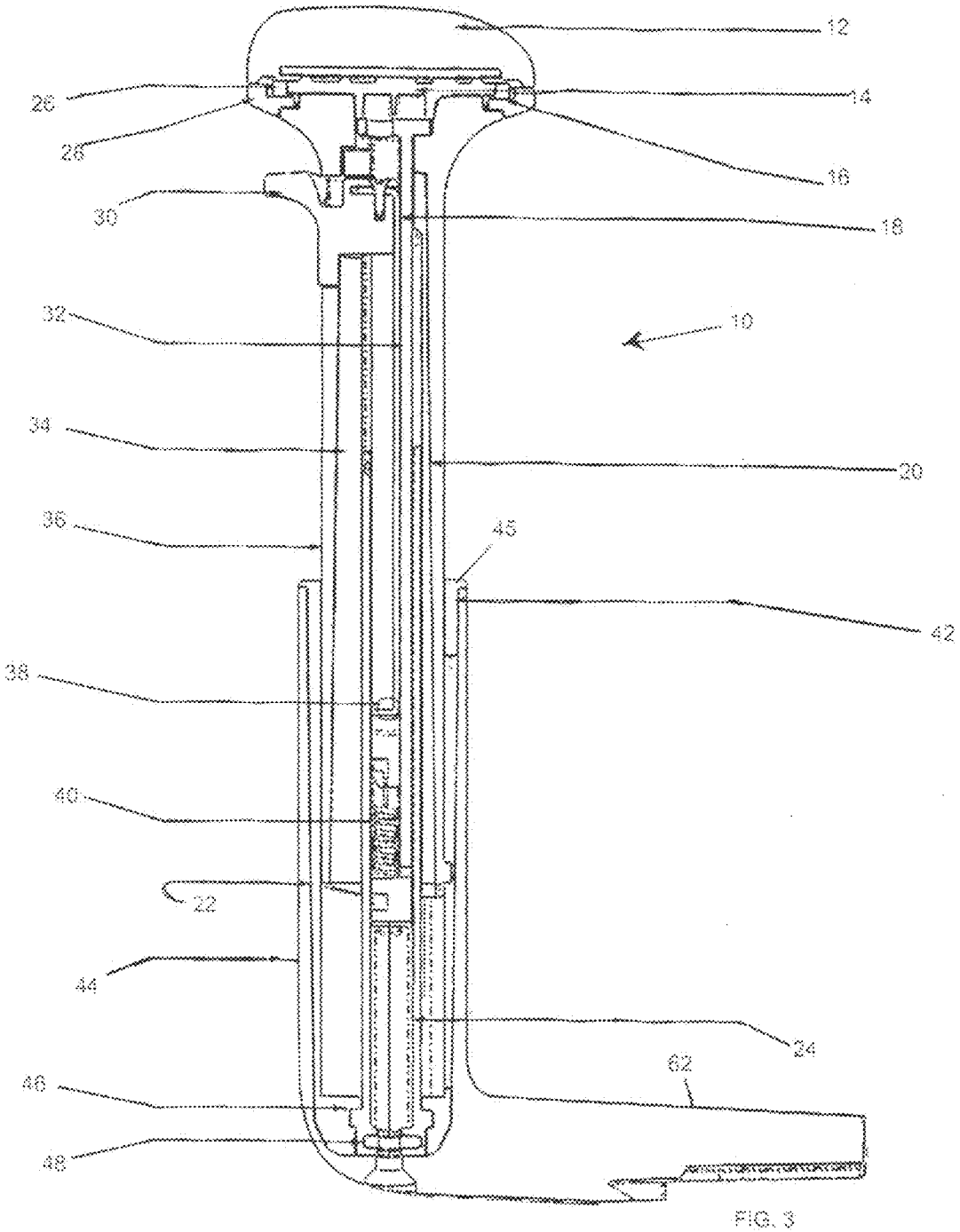
FIG. 3 is a sectioned view in front elevation of an adjustable armrest as disclosed herein.

Looking more particularly to the drawings, an adjustable armrest according to the invention is indicated generally at 10 in FIGS. 1 through 3. Further, the components of the adjustable armrest 10 are illustrated in sequential stages of assembly in FIGS. 6 through 14. It will be understood that, while only one adjustable armrest 10 is shown in many of the accompanying drawings, the opposite armrest 10 will be a mirror image thereof.

The depicted armrest 10 can be considered to be founded on a lower casting 44 that would typically be fastened, such as by mechanical fasteners or otherwise, to a chair body (not shown) passed through apertures in a base plate 62 of the lower casting 44. The lower casting 44 has a rigid sleeve portion 45 that can have, for example, a D-shaped cross section.

An outer bottom sleeve half 22 has a C-shaped cross section and is received into the curved outer segment of the sleeve portion 45 of the lower casting 44 such that outer sleeve half 22 and the sleeve portion 45 have substantially corresponding shapes. Inner bottom sleeve half 42 is received into the flat inner segment of the sleeve portion 45 of the lower casting 44. The inner sleeve half 42 and the sleeve portion 45 have substantially corresponding shapes.

An outer core sleeve half 46 and an inner core sleeve half 24 are received into a volume defined within the outer bottom sleeve half 22 and the inner bottom sleeve half 42. A locking disk 48 is matingly received into correspondingly shaped channels in the lower ends of the outer core sleeve half 46 and the inner core sleeve half 24. Each of the sleeve halves 24 and 46 has a longitudinal channel therein with a series of longitudinally spaced inlets therealong with interposed ridges. Inner and outer top sleeve halves 20 and 34 are received by the inner and outer bottom sleeve halves 42 and 22, and a central core 32 is disposed between the inner and outer top sleeve halves 20 and 34. An upper casting 36 is disposed to house the inner and outer top sleeve halves 20 and 34 and the components therewithin. The series of sleeves formed by the sleeve halves 20, 22, 24, 34, 42, and 46 provides inner and outer core stability to the upper casting 36 as the armrest 10 is telescoped up and down.

An armrest pad 12 is secured to the upper end of the upper casting 36. A top plate 28 of the armrest pad 12 is retained relative to the upper end of the upper casting 36 by a lock plate 14 in combination with mechanical fasteners, a locking ring 26, and a washer 16. As described further hereinbelow, the armrest pad 12 and the top plate 28 can be pivoted about a longitudinal axis of the upper casting 36 to rest in one of a plurality of angular positions.

Figure 4:
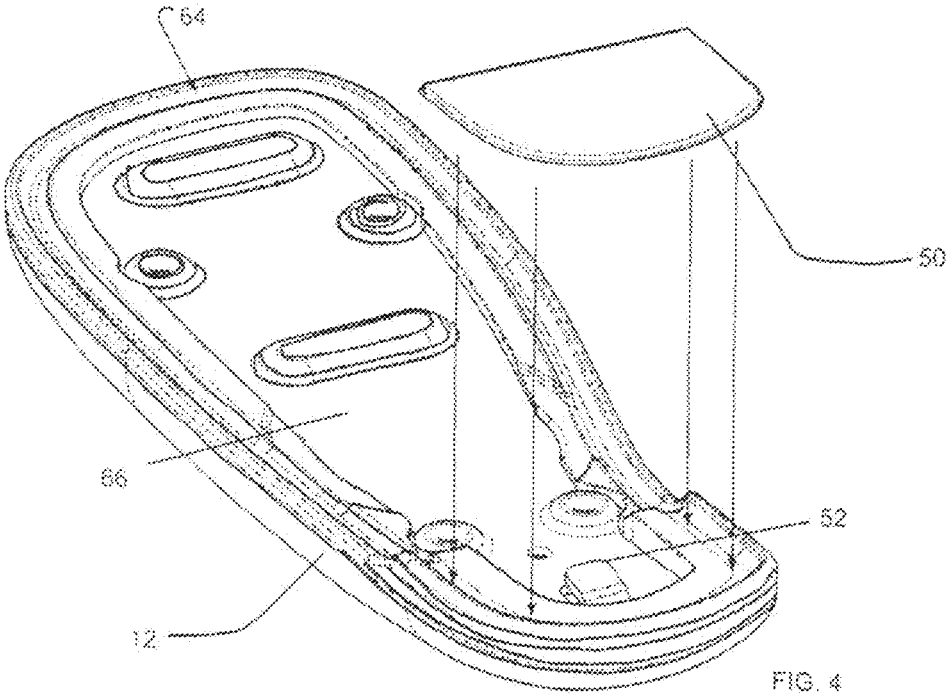
FIGS. 4, 5A, and 5B are perspective views of an armrest pad according to the invention in various stages of assembly.
Figure 5A:
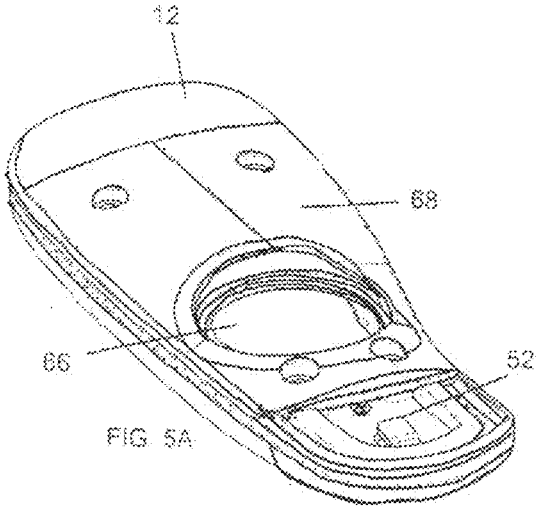
Figure 5B:
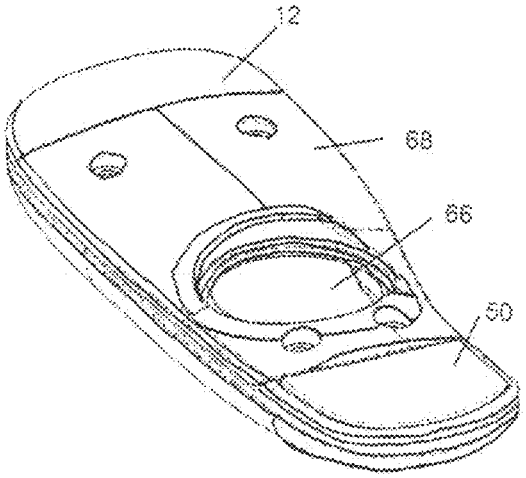

Another refinement of the adjustable armrest 10 can be perceived by further reference to FIGS. 4, 5A, and 5B where the armrest pad 12 is shown alone. There, the underside of the pad 12 can be seen to have a groove 64 along the edge thereof to facilitate the fastening of upholstery, such as by stapling, adhesive, spline, or some other method or combination thereof. The base plate 66 of the pad 12 has a cover 68 applied thereto for shielding the overlapping portions of the groove 64 and the upholstery. The tip portion of the pad 12 is shielded for modesty and structural purposes by a cap 50. The tip portion of the base plate 66 of the pad 12 has an overturned tooth hook 52 that projects posteriorly therefrom. The cap 50 has a receiver, such as an aperture or groove, therein for receiving and engaging the tooth hook 52 thereby to retain the cap 50. The cover 68 and the cap 50 thus cooperate to provide a continuous and protected feel and appearance along the lower face of the arm pad 12.

Height adjustment of the armrest 10 is accomplished by actuation of a locking slide 18 by use of a trigger handle 30. The locking slide 18 is biased to a lowered position by a coil spring 40 and has a tapered and narrowed distal portion that engages first and second locking cylinders 38. When the locking slide 18 is released, the cylinders 38 will tend to lock within opposed inlets along the sleeves 24 and 46. When the locking slide 18 is actuated as by pulling on the trigger handle 30 to lift the locking slide 18 against the biasing force of the spring 40, the tapered and narrowed portion of the locking slide 18 will align with the locking cylinders 38 so that they will be permitted to exit the inlets thereby to permit a telescoping of the armrest 10. Under the foregoing construction, the adjustable armrest 10 is stable, smooth, and reliable in structure and operation.

Figure 6:
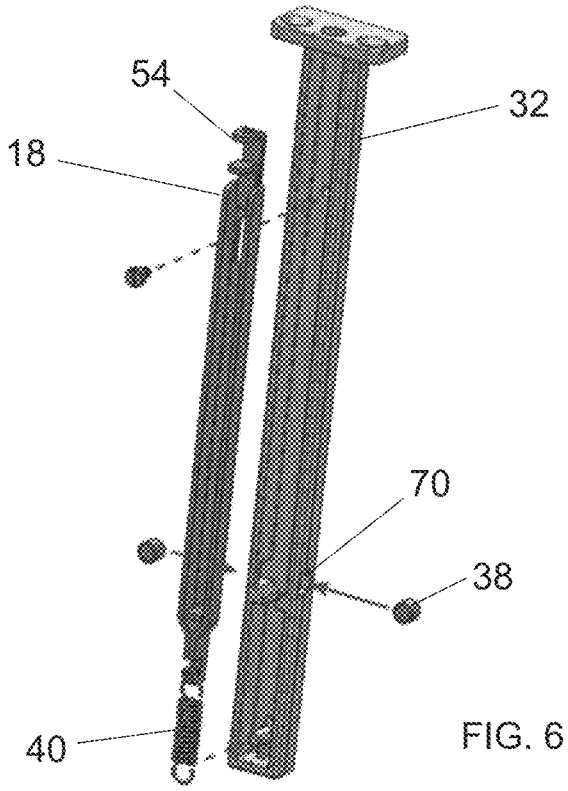
FIGS. 6 through 14 are perspective views of the components of the adjustable armrest in sequential stages of assembly.

Further understanding of the structure and function of the adjustable armrest 10 can be had by additional reference to FIGS. 6 through 14, which show the components of the adjustable armrest 10 in sequential assembly steps. With reference to FIG. 6, during a first stage of assembly, the locking slide 18 and the central core 32 are lubricated, and the spring 40 is coupled at a first end to the lower end of the locking slide 18 and at a second end to a lower portion of the central core 32 as by being connected to a post. The locking slide 18 is secured to the central core 32 by a shoulder screw such that the locking slide 18 can still be slid longitudinally, such as by operation of the trigger 54.

The first and second locking cylinders 38 are inserted into the central core 32 to project partially through windows 70 in opposed front and rear walls of the central core 32 that define a receiving channel for the locking slide 18. The locking slide 18 is then inserted into the receiving channel with the body portion of the locking slide 18 locking the locking cylinders 38 in place projecting partially through the windows 70. As noted above, when the central core 32 and the locking slide 18 are so assembled, actuation of the locking slide 18 by pulling on the trigger handle 30 and thus the handle 54 will lift the locking slide 18 against the biasing force of the spring 40 to cause the tapered or narrowed lower portion of the locking slide 18 to be disposed adjacent to the locking cylinders 38. With that, the cylinders 38 are permitted to move inwardly no longer to project through the windows 70. When the armrest 10 is fully assembled, the inward movement of the locking cylinders 38 will permit their disengagement from the inlets in the inner and outer core sleeve halves 24 and 46 thereby to permit a telescopic raising and lowering of the upper portion of the adjustable armrest 10.

Figure 7:
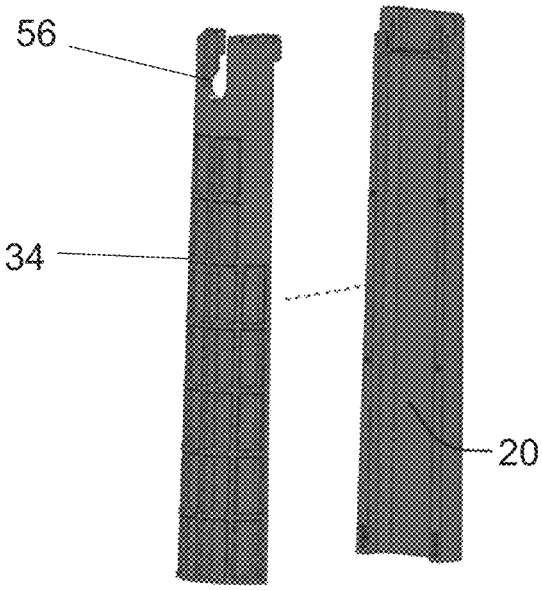
Figure 8:
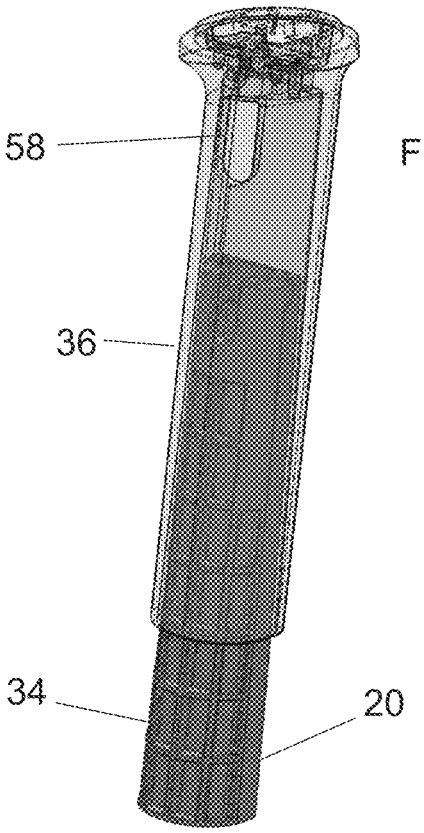

In a subsequent stage of assembly as depicted in FIGS. 7 and 8, the inner top sleeve half 20 and the outer top sleeve half 34 can be coupled in a facing relationship and then inserted longitudinally into the upper casting 36 through the open end thereof. The outer top sleeve half 34 has a longitudinal slot 56 at the upper end thereof, and the upper casting 36 has a longitudinal slot 58 at the upper end thereof in alignment with the longitudinal slot 56 in the outer top sleeve half 34. The longitudinal slots 56 and 58 align with and permit longitudinal movement of the trigger 54 and the trigger handle 30.

Figure 9:
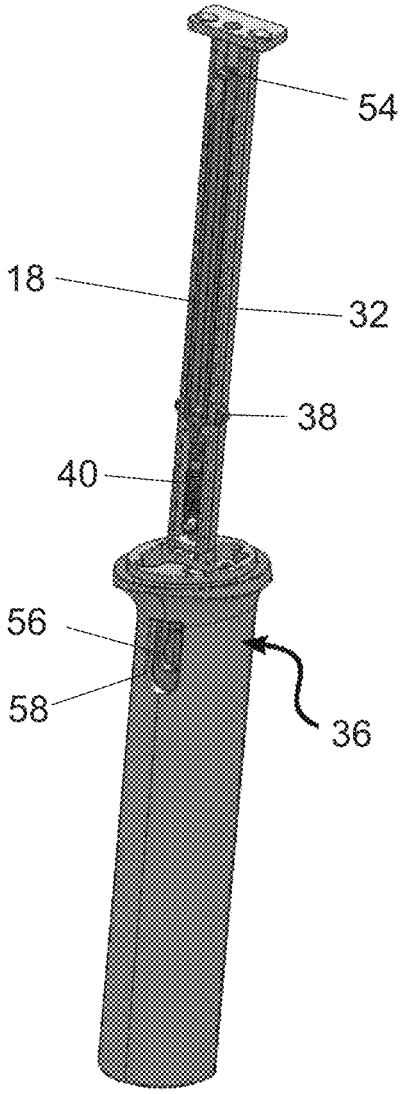

Looking to FIG. 9, the assembled locking slide 18 and central core 32 can then be slid longitudinally into the upper casting 36 from the upper end thereof to cause the trigger 54 to align with the longitudinal slots 56 and 58. The locking slide 18 and the central core 32 can be secured in place by mechanical fasteners (shown in FIG. 2) passed through a flange fixed to the upper end of the central core 32 and into the upper end of the upper casting 36.

Figure 10:
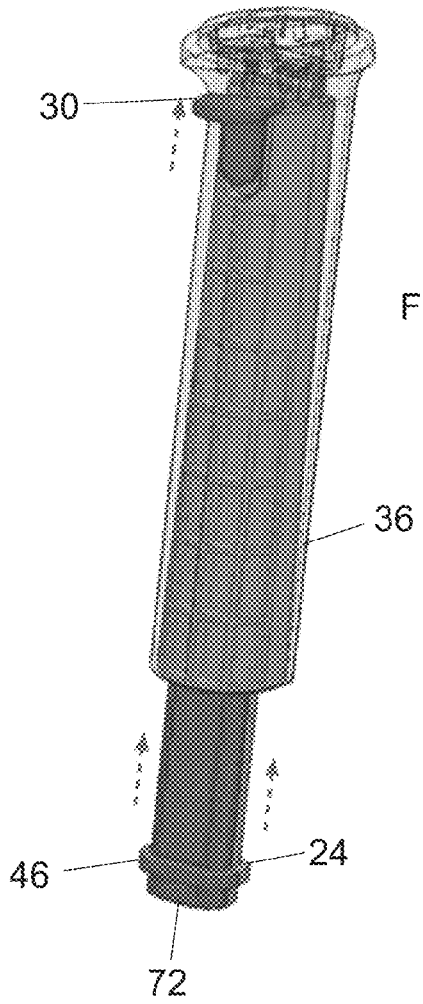

Then, as seen in FIG. 10, the inner and outer core sleeve halves 24 and 46 can be joined with the locking disc 48 of FIG. 2 ensuring proper alignment and positioning between the sleeve halves 24 and 46 and the inlets and ridges of the inner faces thereof. The assembled sleeve halves 24 and 46 form a complete sleeve that can then be slid longitudinally into the assembled upper casting 36 and the inner top sleeve half 20 and the outer top sleeve half 34 such that the outer core sleeve halves 24 and 46 longitudinally receive the locking slide 18 and the central core 32 therein. To permit this sliding reception, the trigger handle 30 must be actuated to permit the locking cylinders 38 to clear way to permit their passage past the inlets and ridges of the inner faces of the sleeve halves 24 and 36. Once the sleeve halves 24 and 46 are positioned as desired, the trigger handle 30 can be released thereby to push the locking cylinders 38 through the windows 70 and into the adjacent inlets thereby locking the sleeve formed by the sleeve halves 24 and 46 in a given longitudinal position. When the components are so assembled, the lower end of the assembly formed by the sleeve halves 24 and 46 projects beyond the lower end of the upper casting 36, and a peripheral retaining ridge 72 encircles the lower end of the assembled sleeve halves 24 and 46.

Figure 11A:
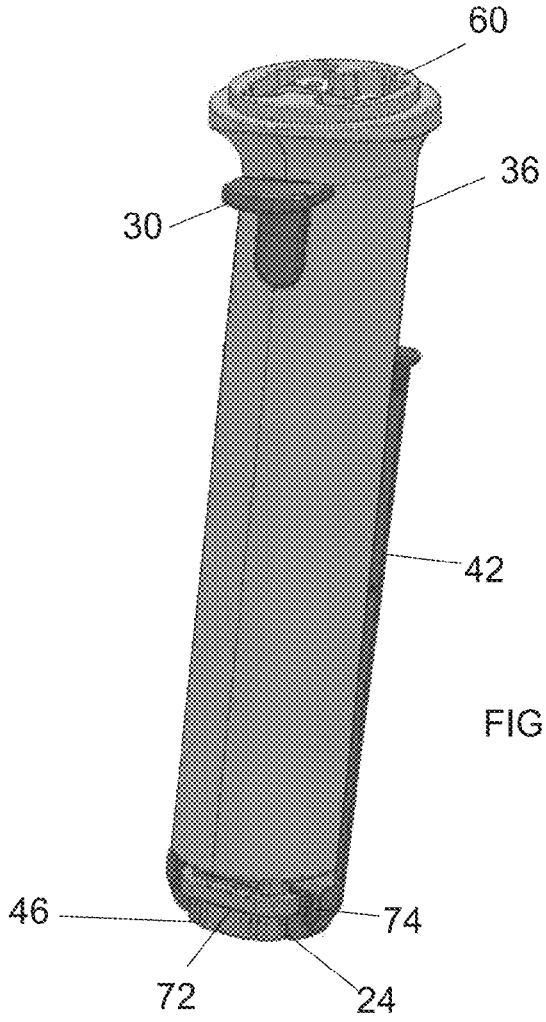
Figure 11B:
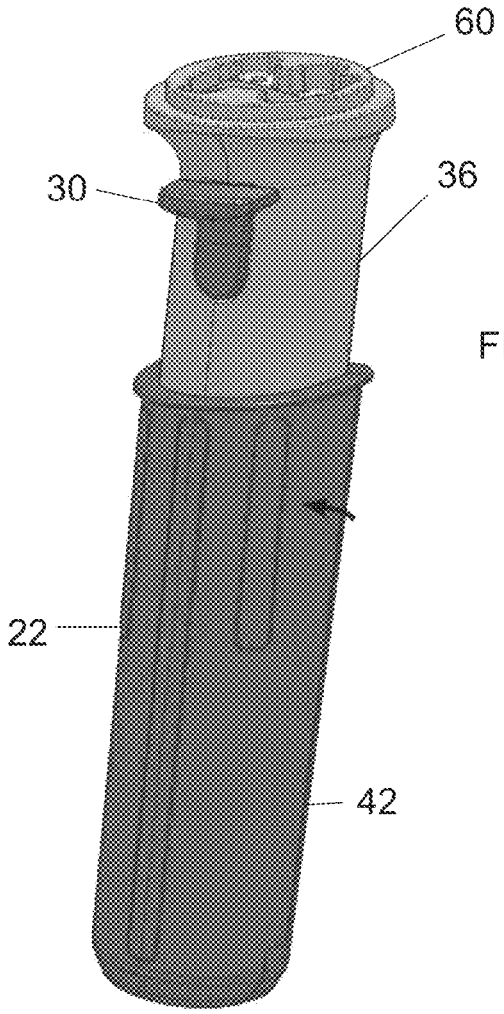

With the parts so assembled, the outer bottom sleeve half 22 and the inner bottom sleeve half 42 can be disposed to encase the lower portion of the upper casting 36 as shown in FIGS. 11A and 11B. The outer and inner bottom sleeve halves 22 and 42 have inwardly facing retaining channels for matingly engaging and longitudinally retaining the peripheral retaining ridge 72 of the lower end of the assembled sleeve halves 24 and 46. With that, when the outer and inner bottom sleeve halves 22 and 42 encase the upper casting 36, the lower ends of the core sleeve halves 24 and 46 will be fixed against relative longitudinal movement while the upper casting 36 will be permitted to slide longitudinally upon an actuation of the trigger handle 30 and the underlying trigger 54.

Figure 12:
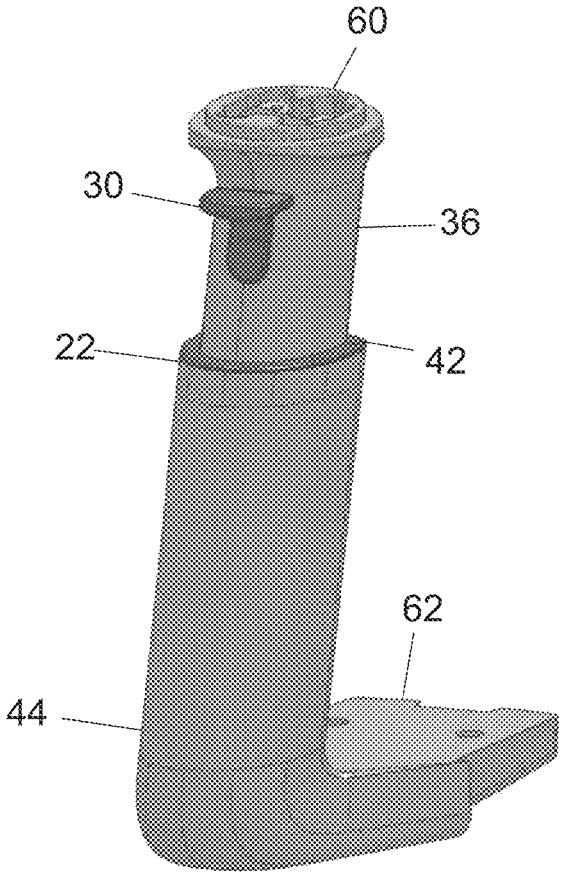
Figure 13:
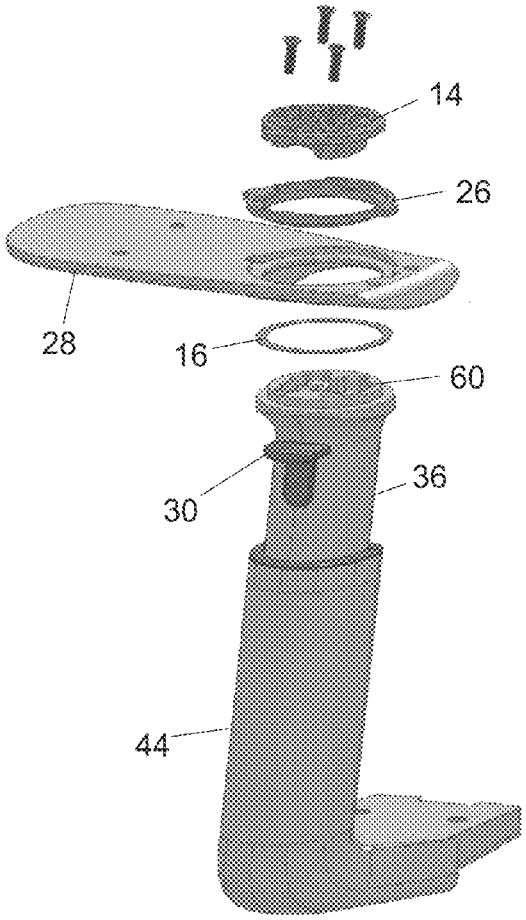
Figure 14:
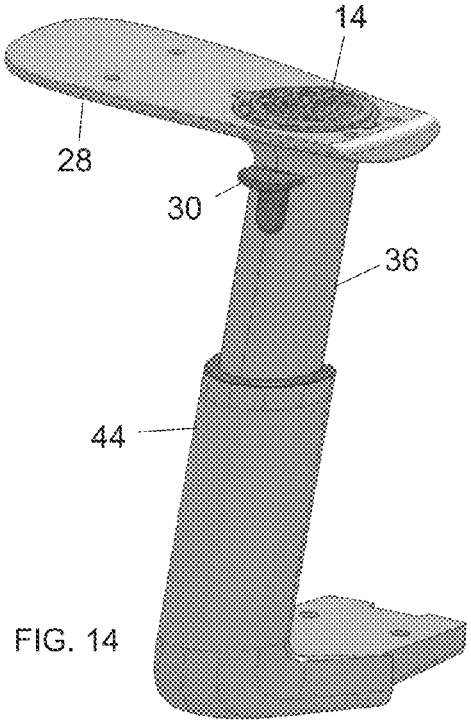

In a further assembly stage as shown in FIG. 12, the assembly formed with, among other components, the outer and inner bottom sleeve halves 22 and 42 can be slid longitudinally into the lower casting 44 through the open upper end thereof until upper flange edges of the outer and inner bottom sleeve halves 22 and 42 contact the upper rim of the lower casting 44. A fastener 76 can then be passed through the lower end of the lower casting 44 and into the upper assembly to engage the locking disk 48 thereby to secure the lower casting 44 to the assembled core sleeve halves 24 and 46 while permitting a selective raising and lowering of the upper casting 36.

Assembly can continue by fastening the top plate 28 to the upper end of the upper casting 36. To do so, a washer 16 is disposed atop the upper end of the upper casting, the tope plate 28 is disposed atop the washer 16, a locking ring 26 atop the top plate 28, and a lock plate 14 atop the locking ring 26. Then, mechanical fasteners are passed through the lock plate 14 and into the mating head 60 of the upper casting 36 thereby to fasten the top plate 28 in place. The armrest pad 12 can then be fastened to the top plate 28 by further mechanical fasteners passing through the top plate 28 and into the base plate 66 of the armrest pad 12.

Looking additionally to FIG. 15 where left and right adjustable armrests 10A and 10B are shown, it can be seen that the armrest pads 12A and 12B can be selectively pivoted about longitudinal pivot axes PA in relation to the upper castings 36A and 36B to rest in one of a plurality of angular positions. More particularly, in this example of the invention, the armrest pad 12 can be pivoted to and from a first angular position in longitudinal alignment with the chair (not shown) to which the armrests 10A and 10B are attached through the base plates 62A and 62B, a second angular position pivoted outboard by 22.5 degrees, and a third angular position pivoted outboard by 45 degrees. To facilitate the pivoting of the armrest pad 12, looking again to FIG. 13, the locking ring 26 and the lock plate 14 can have spaced eccentricities that act as stops and guides to the pivoting of the armrest pad 12.

With certain details and embodiments of the present invention for an adjustable armrest 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. An adjustable armrest comprising:

an elongate central core with a longitudinal channel;

first and second windows in the elongate central core;

a locking slide slidably received in the longitudinal channel in the central core;

first and second locking members retained by the elongate central core;

wherein the locking slide has a first position wherein the at least one locking member is pressed by the locking slide to a position projecting at least partially outboard of the elongate central core and a second position wherein the at least one locking member is permitted to retract within the elongate central core, wherein the first and second locking members respectively project at least partially through the first and second windows of the elongate central core when the locking slide is in the first position, wherein the locking slide has a narrowed portion that comprises a tapered distal portion of the locking slide, and wherein the narrowed portion of the locking slide is aligned with the at least one locking member when the locking slide is in the second position;

an elongate core sleeve with a plurality of longitudinally spaced inlets and ridges wherein the elongate central core is received within the elongate core sleeve;

a first arm portion fixed in relation to the elongate central core; and a second arm portion fixed in relation to the elongate core sleeve;

whereby the first arm portion can be extended and retracted in relation to the second arm portion by an actuation of the locking slide from the first position to the second position.

2. The adjustable armrest of claim 1 wherein the locking slide is biased to the first position.

3. The adjustable armrest of claim 1 further comprising a trigger for actuating the locking slide between the first position and the second position.

4. The adjustable armrest of claim 1 wherein the elongate core sleeve is formed by first and second sleeve halves.

5. The adjustable armrest of claim 1 wherein the second arm portion comprises a lower casting with a base portion for being fastened to a chair and wherein the elongate core sleeve is fixed relative to the lower casting.

6. The adjustable armrest of claim 5 wherein the elongate core sleeve is formed by first and second core sleeve halves and further comprising a locking disk interposed between the first and second core sleeve halves.

7. The adjustable armrest of claim 1 further comprising an armrest pad retained by the first arm portion.

8. The adjustable armrest of claim 7 wherein the armrest pad is pivotable about a longitudinal axis in relation to the first arm portion.

9. The adjustable armrest of claim 1 further comprising a handle for permitting an actuation of the locking slide from the first position to the second position.

10. The adjustable armrest of claim 1 wherein the first arm portion comprises an upper arm casting with an upper end and a lower end and wherein the second arm portion comprises a lower casting with an upper end and a lower end.

11. An adjustable armrest comprising:

an elongate central core with a longitudinal channel;

a locking slide slidably received in the longitudinal channel in the central core;

at least one locking member retained by the elongate central core;

wherein the locking slide has a first position wherein the at least one locking member is pressed by the locking slide to a position projecting at least partially outboard of the elongate central core and a second position wherein the at least one locking member is permitted to retract within the elongate central core;

an elongate core sleeve with a plurality of longitudinally spaced inlets and ridges wherein the elongate central core is received within the elongate core sleeve;

a first arm portion fixed in relation to the elongate central core; and a second arm portion fixed in relation to the elongate core sleeve;

whereby the first arm portion can be extended and retracted in relation to the second arm portion by an actuation of the locking slide from the first position to the second position;

wherein the first arm portion comprises an upper arm portion with an upper end and a lower end and wherein the second arm portion comprises a lower arm portion with an upper end and a lower end and wherein the elongate central core is fixed to the upper end of the upper arm portion and wherein the elongate core sleeve is fixed to the lower end of the lower arm portion.

12. The adjustable armrest of claim 11 wherein the elongate central core is formed by first and second core sleeve halves and further comprising a locking disk interposed between the first and second core sleeve halves and wherein the elongate core sleeve is fixed to the lower arm portion by a fastener passed through the lower arm portion and into the locking disc.

13. The adjustable armrest of claim 11 further comprising an outer bottom sleeve disposed to encase a lower portion of the upper portion and wherein the outer bottom sleeve is fixed in relation to the elongate core sleeve.

14. The adjustable armrest of claim 13 wherein the outer bottom sleeve is formed from first and second bottom sleeve halves and wherein the outer bottom sleeve is fixed in relation to the elongate core sleeve by a mating engagement between a retaining channel fixed in relation to one of the outer bottom sleeve and the elongate core sleeve and a retaining ridge fixed in relation to the other of the outer bottom sleeve and the elongate core sleeve.

* * * * *